US006320482B1

(12) United States Patent
Ala-Kojola et al.

(10) Patent No.: US 6,320,482 B1
(45) Date of Patent: Nov. 20, 2001

(54) HIGH FREQUENCY FILTER CONSISTING OF INTEGRAL BODIES

(75) Inventors: Jouni Ala-Kojola, Kempele; Kari Lohtander, Oulunsalo; Esa Mikkonen, Oulu; Juha Korpela, Kempele, all of (FI)

(73) Assignee: LK-Product Oy, Kempele (FI)

( * ) Notice: Subject to any disclaimer, the term of this patent is extended or adjusted under 35 U.S.C. 154(b) by 0 days.

(21) Appl. No.: 09/327,705

(22) Filed: Jun. 8, 1999

(30) Foreign Application Priority Data

Jun. 11, 1998 (FI) ..... 981348
Nov. 25, 1998 (FI) ..... 982551

(51) Int. Cl.[7] ..... H01P 1/205; H01P 1/202

(52) U.S. Cl. ..... 333/206; 333/202; 333/203; 333/222

(58) Field of Search ..... 333/222, 203, 333/206, 202

(56) References Cited

U.S. PATENT DOCUMENTS 5,130,683 * 7/1992 Agahi-Kesheh et al. ..... 333/203
5,990,763 * 11/1999 Sipila ..... 333/202

FOREIGN PATENT DOCUMENTS

823746 A3 12/1998 (EP) .

* cited by examiner

*Primary Examiner*—Robert Pascal
*Assistant Examiner*—Stephen E. Jones
(74) *Attorney, Agent, or Firm*—Darby & Darby

(57) ABSTRACT

A resonator or a filter consisting of resonators comprises an inner conductor or conductors and an outer conductor enclosing the inner conductor or conductors. It comprises a first part (201, 301, 401, 604, 701) and a second part (202, 302, 420, 501, 605, 702), of which the first part comprises at least a part of the inner conductor or conductors (203, 303, 402, 404, 703, 704, 705, 706, 707) and a part of the outer conductor (204, 205, 304, 305, 405, 406, 407, 408, 409), which is integral with the inner conductor parts and made of the same material, and of which the second part comprises such a part of the outer conductor (206, 207, 304, 305, 421, 422, 423, 424, 425) which, when connected to the first part, forms a continuous outer conductor enclosing the inner conductor.

6 Claims, 4 Drawing Sheets

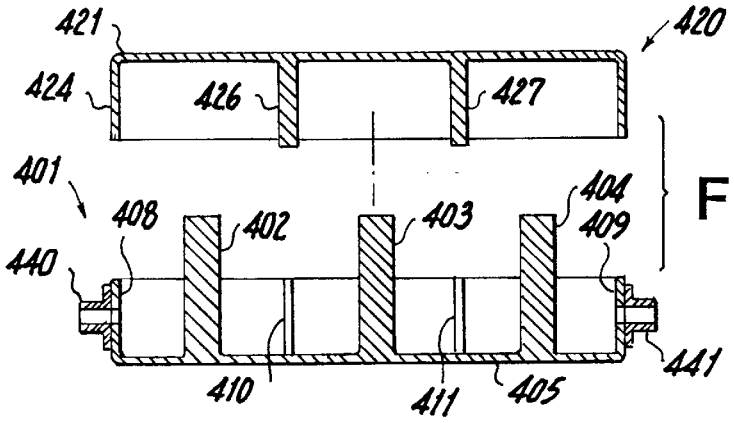
Fig. 4
Fig. 4(a)
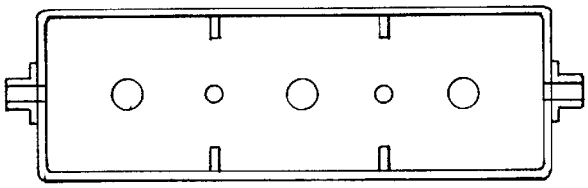
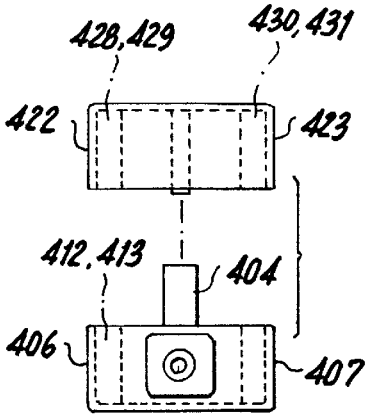
Fig. 4(b)
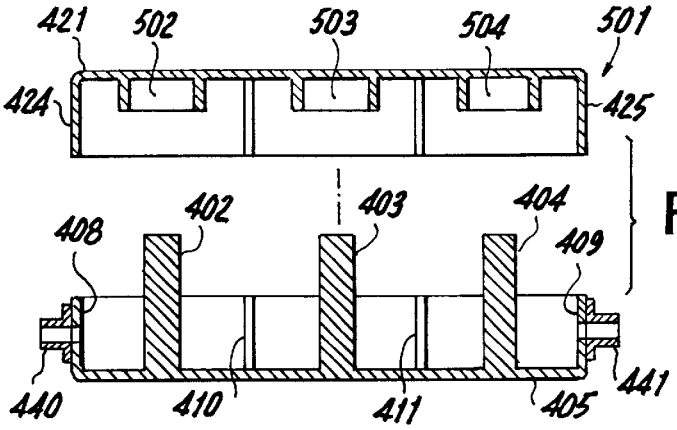
Fig. 5
Fig. 5(a)
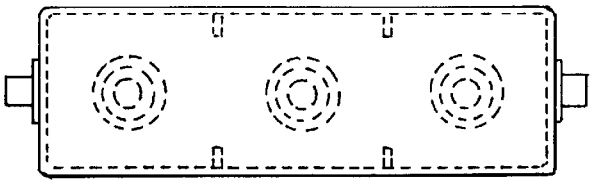
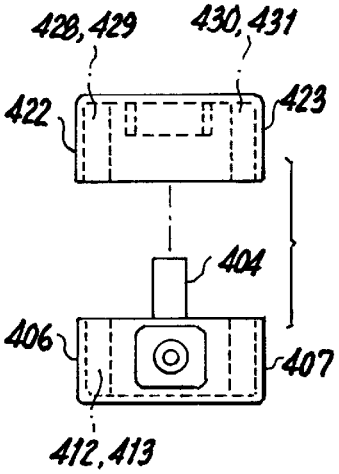
Fig. 5(b)

HIGH FREQUENCY FILTER CONSISTING OF INTEGRAL BODIES

TECHNOLOGICAL FIELD

The invention relates generally to the structures of resonator filters used at frequencies of hundreds of megahertz and several gigahertz. Particularly the invention relates to a filter structure which consists of a small number of integral components, and to a method for manufacturing a filter of this kind.

BACKGROUND OF THE INVENTION

Regarding mobile communication systems the essential operating frequencies are located in a frequency domain, which extends from hundreds of megahertz to several gigahertz, and in microwave links between the stationary parts of the network, even to tens of gigahertz. The filters which are used at these frequencies are generally based on resonators comprising an inner conductor surrounded by an outer conductor. The resonators are divided into different types, usually on the basis of structural details. Known resonator types are for instance the helix, the coaxial, the microstrip and the dielectric resonators; the filters are correspondingly called helix, coaxial, microstrip and dielectric filters. The filter resonators are also called filter stages or filter circuits.

FIG. 1 is a schematic cross-section of a known coaxial filter having three resonators. The inner conductors 101 of the resonators are fastened at one end (in the figure the lower end) to a printed circuit board 102 so that the printed circuit board has a hole 103 for each inner conductor, into which hole the lower end of the inner conductor is pushed. On the bottom surface of the printed circuit board 102 there is a substantially continuous ground plane 104, which after the assembly is connected in an electrically conducting manner (for instance by solder) to the lower end of each inner conductor. The top surface of the printed circuit 102 board comprises electrically conducting patterns 105, which arrange the connections from a filter input port to the resonator which is closest to the input port, and correspondingly to the filter's output port from the resonator which is closest to the output port. The patterns 105 can further have an effect on the electromagnetic couplings between the resonators. The inner conductors are enclosed in an electrically conducting box structure 106 which forms the outer conductor of each resonator and which at the same time acts as the mechanical outer cover of the filter. At the edges it is connected to the ground plane 104 on the bottom surface of the printed circuit board 102. The input and output ports of the filter are isolated from the electrically conducting outer cover.

A relatively large number of components is typical for the prior art filter structures. This causes inconvenience in the assembly because the large number of separate components increases manufacturing costs and tends to cause dimensioning variations in the final products. Further it is typical to the prior art filter structures comprising several components that they have intermodulation problems, which means a non-linear mixing of two or more signals and the non-harmonic frequencies resulting from the mixing. The connection surfaces of the separate components connected to each other form a significant source of intermodulation, particularly when the signals have a high power level. The rusty bolt effect means a phenomenon where contact surfaces, not well matched to each other, an insufficient tightening torque, oxidation, corrosion, impurities on the contact surfaces, or some other factor, results in that the electrically conducting continuous surfaces in the junction between two metal bodies are not tightly abutting each other. Then there exists a substantial uncontrolled resistance and/or capacitance between them, which causes non-linear current-voltage effects in the electric current passing through the junction. The non-harmonic frequencies generated by the intermodulation can be extremely harmful, for instance if they happen to overlap a useful signal.

SUMMARY OF THE INVENTION

The object of the present invention is to present a resonator and filter structure which consists of relatively few components and where the disadvantages caused by the junctions between separate parts are minimised. An object of the invention is also to present a resonator and filter structure which is favourable regarding the manufacturing techniques. A further object of the invention is to present a method for manufacturing the resonator and filter structure according to the invention.

The objects of the invention are attained by manufacturing a resonator and a filter, which comprises resonators, of substantially two body components, of which the first one comprises a substantial part of the inner conductor or inner conductors as well as the bottom and side walls of the box structure, and of which the second one comprises the lid of the box structure and possibly some coupling means affecting the electromagnetic characteristics of the resonators.

A resonator according to the invention is characterised in that it comprises a first part and a second part, of which the first part comprises at least a part of the inner conductor and a part of the outer conductor which is integral with the inner conductor and made of the same material, and of which the second part comprises such a part of the outer conductor which, when connected to the first part, forms a continuous outer conductor enclosing the inner conductor.

A filter according to the invention is characterised in that it comprises a first part and a second part, of which the first part comprises at least a part of the inner conductors of the resonators as well as a part of the outer conductor, which is integral with the inner conductors and made of the same material, and of which the second part comprises such a part of the outer conductor which, when connected to the first part, forms a continuous outer conductor enclosing the inner conductors.

The invention relates also to a method which is characterised in that it comprises steps in which

- a first integral part is formed in one operation, so that the first part comprises at least a part of the inner conductor and a part of the outer conductor, which is integral with the inner conductor and made of the same material,
- a second integral part is formed in one operation, so that the second part comprises a part of the outer conductor, and
- the first and the second parts are attached to each other so that they form a continuous outer conductor enclosing the inner conductor.

According to the invention two integral bodies are manufactured, of which the first body comprises an essential part of the inner conductors of the resonator or resonators as well as an essential part of the electrically conducting box structure surrounding the inner conductors. The second part comprises the rest of the box structure, and it is attached to the first part so that an integral box structure is formed. If the structure comprises two or more resonators, then the first and/or the second part further comprises coupling and/or matching means, which have an effect on the electromagnetic characteristics of the resonators and on the electromagnetic couplings between the resonators.

The second part can also comprise a part of an inner conductor or inner conductors, whereby a complete inner conductor is formed only when the parts are attached to each other. In such a case the inner conductor sections contained in the different parts can even have a different thickness, whereby an impedance step of the inner conductor is formed at the joint between the parts.

Extruding is a preferred method for manufacturing the first and second parts. A metallic or metal containing, or a raw material which otherwise has a good electrical conductivity, is pressed at a high pressure into a mould, whereby it gets the desired form, and its different sections, such as the inner conductors and the grounding substrate connected to one end of the inner conductors, are seamlessy attached to each other. An extruded article can be very exactly dimensioned, also in series production. The interface between the first and second parts is advantageously located so that it is relatively far away from the joints between the inner and outer conductors. When the filter is in use the highest currents occur at the joint between the inner conductor and the outer conductor and in the immediate vicinity of the joint. The rusty bolt effect and the intermodulation caused by it can be mainly avoided when there are no interfaces between the two bodies close to this joint.

BRIEF DESCRIPTION OF DRAWINGS

The invention is described in more detail below with reference to preferred embodiments presented as examples and to the enclosed drawings, in which:

FIG. 4 shows schematically, from a front elevational view, a filter according to the invention;

FIG. 4(*a*) shows schematically, from a top plan view, the filter of FIG. 4;

FIG. 4(*b*) shows schematically, from a side elevational view, the filter of FIG. 4;

FIG. 5 shows schematically, from a front elevational view, a second filter according to the invention;

FIG. 5(*a*) shows schematically, from a top plan view, the filter of FIG. 5;

FIG. 5(*b*) shows schematically, from a side elevational view, the filter of FIG. 5;

FIG. 6(*a*) shows schematically, from a top plan view, the filter of FIG. 6;

FIG. 6(*b*) shows schematically, from a side elevational view, the filter of FIG. 6;

FIG. 7(*a*) shows schematically, from a top plan view, the filter of FIG. 7;

FIG. 7(*b*) shows schematically, from a side elevational view, the filter of FIG. 7;

In connection with the description of prior art above reference was made to the FIG. 1, so in the following description of the invention and of its preferred embodiments reference is mainly made to the FIGS. 2 to 8. The same reference numerals are used for corresponding parts in the figures.

DETAILED DESCRIPTION OF THE INVENTION

Figure 1:
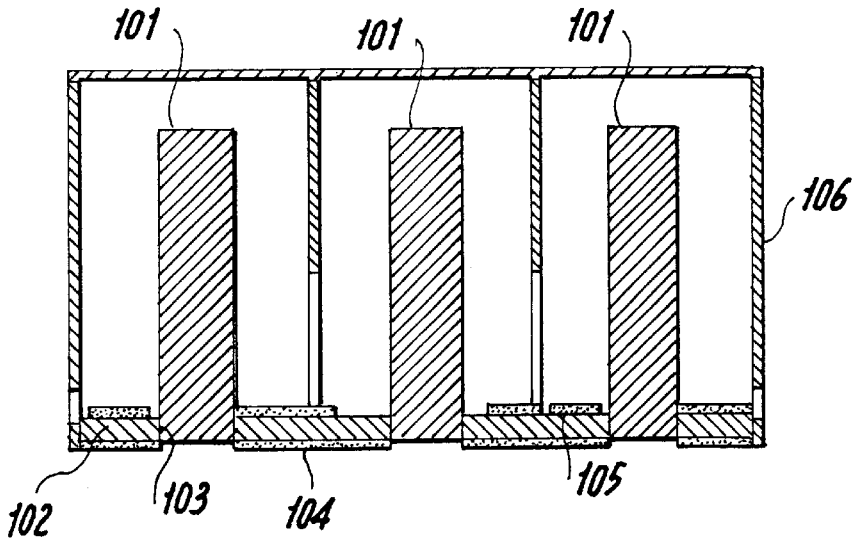
Fig. 1 (Prior Art)
FIG. 1 shows a prior art filter.
Figure 2:
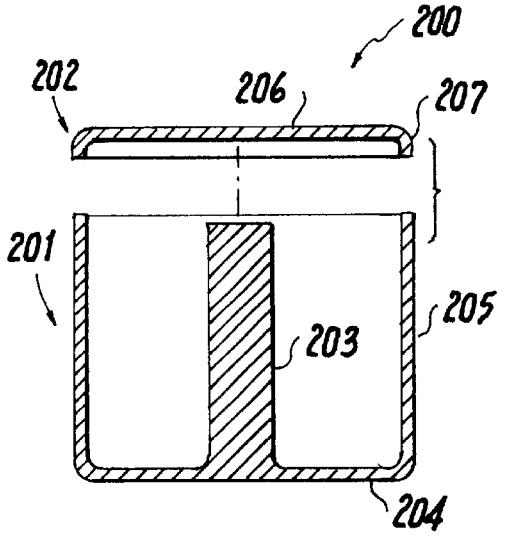
FIG. 2 shows schematically a resonator according to the invention.

FIG. 2 shows a schematic cross-section of the parts in a coaxial resonator 200 according to the invention, the parts being the frame part 201 and the lid part 202. The frame part comprises the inner conductor 203, the bottom 204 and the side walls 205. The lid part comprises the lid 206 and the edges 207. The parts are dimensioned so that when the lid part is attached over the frame part according to the broken lines there is formed a tight, closed outer conductor, which encloses the inner conductor 203. The parts can be fastened to each other by any fastening method known per se, which provides an electrically conducting joint between two electrically conducting bodies. In the final structure the inner conductor has a fixed connection to the outer conductor at its first end (at the lower end), and its second end (the upper end) is open. The resonator is dimensioned to be a quarter-wave resonator at such an operating frequency at which the electrical length of the inner conductor is a quarter of the wavelength.

The frame part 201 and the lid part 202 according to the FIG. 2 are advantageously manufactured by extruding, for instance of aluminium, of an aluminium based metal alloy, or of some other electrically well conducting material known per se, which is suitable for the extruding. When reference is made to the upper end and the lower end, to the lid and the bottom, and when other notions of direction are used, the intention is only to illustrate the relation of the description to the enclosed figures, and these notions do not limit the manufacture or use of the structure according to the invention in any particular direction. These observations regarding materials and directions can also be generalized concerning the other embodiments of the invention presented below, FIG. 2 does not show the means for making electrical connections to the resonator shown in the figure, but such electrical connections can be made by means known to a person skilled in the art, for instance by a lead-through connector which is fastened to one of the side walls.

Figure 3:
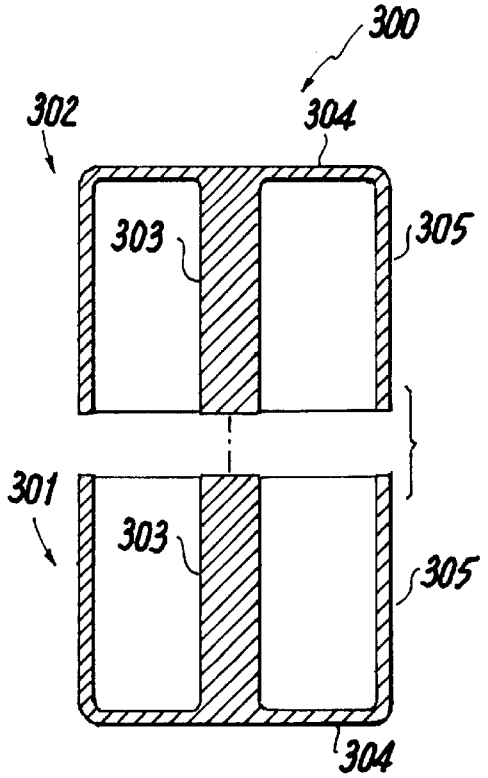
FIG. 3 shows schematically another resonator according to the invention.

FIG. 3 shows a schematic cross-section of the parts in another coaxial resonator 300 with a structure according to the present invention. The first part 301 and the second part 302 are practically identical. Both have an inner conductor half 303, a bottom 304 and side walls 305. When the parts are attached to each other there is formed a structure where the inner conductor extends as a continuous conductor through the whole structure and is enclosed within a continuous outer conductor. The resonator here is a half-wave resonator, because both ends of the inner conductor are connected to the outer conductor. The electrical connections to the resonator are made in a manner known per se, in the same way as was presented above in connection with the FIG. 2.

In the resonator of FIG. 3 the inner conductor halves could also have a different thickness in different parts, so that an impedance step would be formed in the middle of the inner conductor. In either section, or in both sections, the thickness of the inner conductor can also change, either continuously or in one or more steps. The walls can also have a different thickness in different parts, or the thickness can change continuously in a certain place, or in one or more steps. The thickness can be varying also in the embodiment shown in FIG. 2, as well as in the other embodiments of the invention shown below.

FIGS. 4, 4(*a*) and 4(*b*) show schematically a band-pass filter with three resonators which use the structure according to the invention. The first part 401 comprises the inner conductors 402, 403 and 404, the bottom 405, the sided walls 406 and 407, the gable walls 408 and 409, and the partitions 410, 411, 412 and 413 which project inwards from the side walls and which act as edges of the coupling windows between the resonators. The second part 420 comprises a lid 421, side walls 422 and 423, gable walls 424 and 425, coupling pins 426 and 427, and partitions 428, 429, 430 and 431 which project inwards from the side walls in the same way as in the first part. When the parts are attached to each other they form a structure comprising three adjacent quarter-wave resonators, where the inner conductors are enclosed within a substantially continuous outer conductor, the adjacent resonators "see" each other through the coupling windows defined by the partitions projecting inwards from the side walls, and a coupling pin is located centrally in both coupling windows. FIGS. 4, 4(*a*) and 4(*b*) show also lead-through connectors 440 and 441, to which coaxial cables (not shown in the figure), can be connected, whereby the central conductor of the connector transmits the connection between the inner conductor of the coaxial cable and the resonator closest to the connector.

FIGS. 5, 5(*a*) and 5(*b*) show schematically another filter according to the invention comprising three resonators, and having many features similar to those of the filter in FIGS. 4, 4*a*) and 4(*b*). However, the second part 501 of FIGS. 5, 5(*a*) and 5(*b*) does not contain coupling pins. Instead it comprises three circular coupling hats 502, 503 and 504, and when the filter is assembled each of these hats is located so that it surrounds the inner conductor end of one resonator. By a suitable dimensioning of the coupling hats it is possible to have a substantial effect on the resonance frequencies of the resonators and on the capacitive couplings between them. The suitable dimensions of the coupling hats can be found by testing or by calculated simulations.

Figure 6:
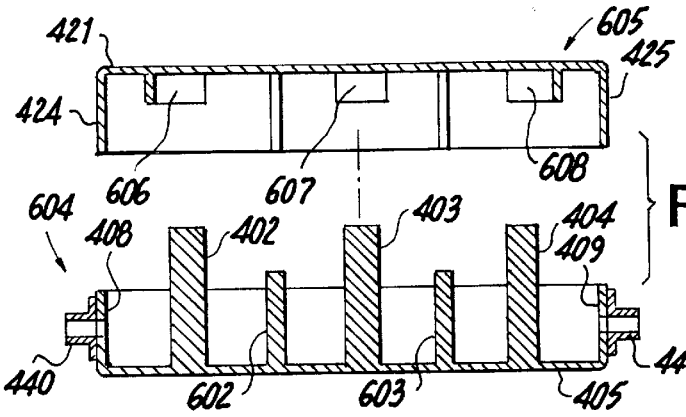
FIG. 6 shows schematically, from a front elevational view, a third filter according to the invention.
Figure 6A:
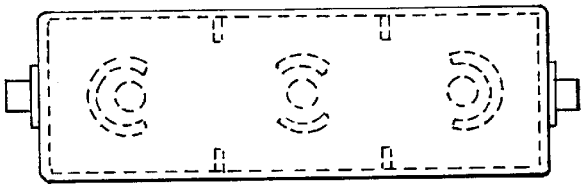
Figure 6B:
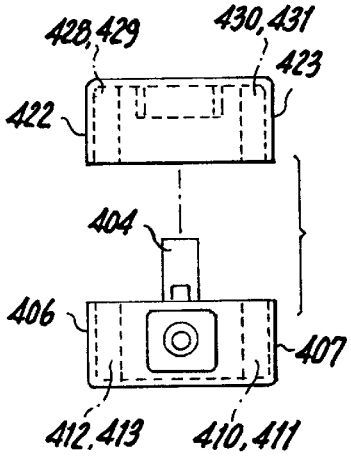

FIGS. 6, 6(*a*) and 6(*b*) show schematically a filter according to the invention which combines features of the filters in FIGS. 4, 4(*a*), 4(*b*), 5, 5(*a*) and 5(*b*). In FIGS. 6, 6(*a*) and 6(*b*) the coupling pins 602 and 603 are formed in the first part 604. Further the coupling hats 607, 608 and 609 in the second part 605 do not have the form of a complete circle in the same way as in FIGS. 5, 5(*a*) and 5(*b*), but they consist of circular arcs of different sizes.

Figure 7:
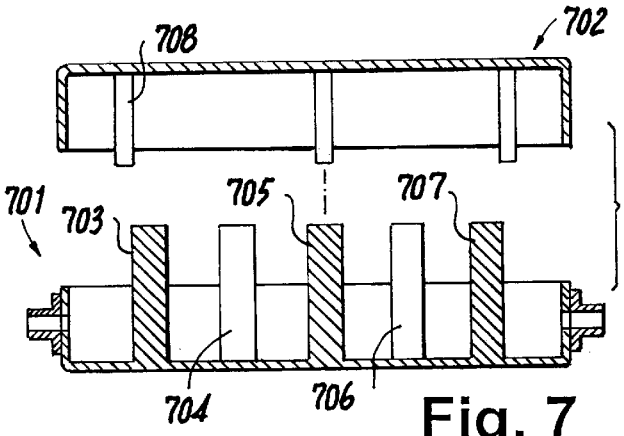
FIG. 7 shows schematically, from a front elevational view, a fourth filter according to the invention.
Figure 7B:
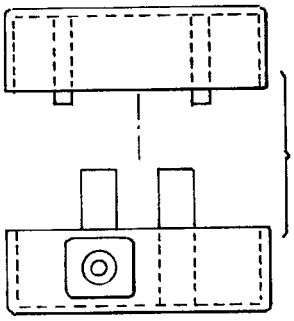
Figure 7A:
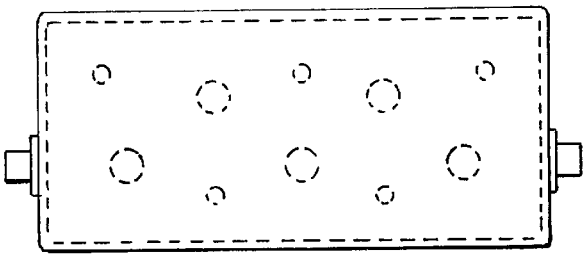

FIGS. 7, 7(*a*) and 7(*b*) show, also schematically, a filter according to the invention which comprises a first part 701 and a second part 702. It has five resonators, whose inner conductors 703, 704, 705, 706 and 707 are not located in a straight line in the same way as in the above presented embodiments, but so that the direction from a certain inner conductor to the next inner conductor is at a certain angle to the longitudinal axis of the filter. In FIGS. 7, 7(*a*) and 7(*b*) these directions have been selected so that their absolute values are equal but the sign is alternating, so that the inner conductors are located in two parallel rows. However, the invention is not limited to such a solution, but the inner conductors can be located quite freely within the filter. With the aid of the coupling elements 708 it is possible to influence the couplings between the resonators. Also other elements than pins can be used as coupling elements, such as different plate-like of band-like projections. The arrangement of FIGS. 7, 7(*a*) and 7(*b*) has several advantageous effects. The length of the filter in the direction of its longitudinal axis is shorter than if the inner conductors would be in a straight row. The arrangement can utilise the electromagnetic couplings also from a certain resonator past the next resonator to the following resonator, or a resonator located still farther away. Further the filter can be designed so that its external form is suitable for a particular application.

Figure 8:
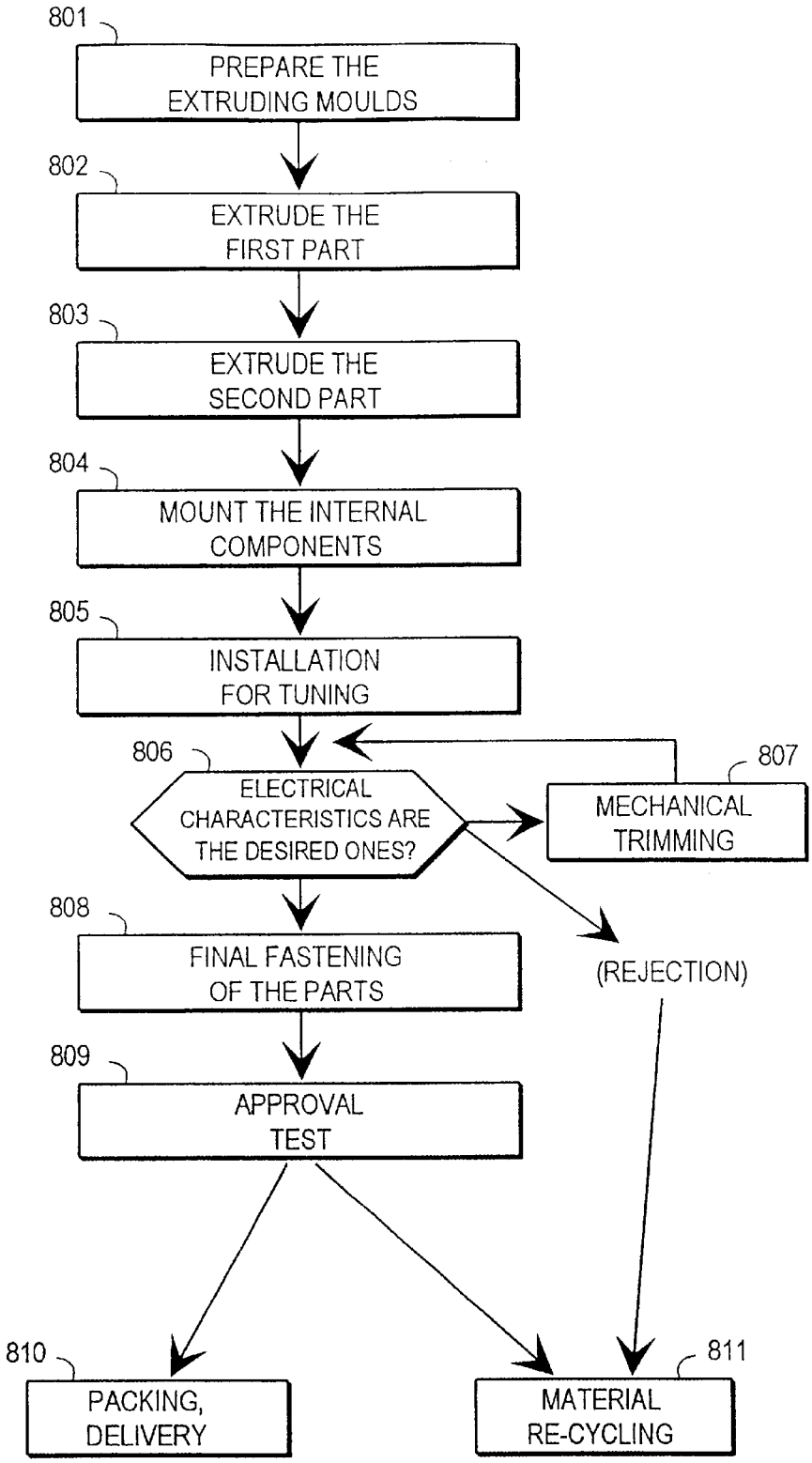
FIG. 8 shows a method according to the invention.

FIG. 8 shows in a flow diagram of a method according to the invention for manufacturing a filter. As the first step of the method the figure shows the manufacture of the extruding moulds 801, which of course are not made separately for each filter, but only at the beginning of a certain production batch. Then there is the manufacture of the first and second parts by extruding in the steps 802 and 803. Any other possible components which at least partly will be located within the filter are most advantageously fastened in step 804 before the final assembly, so that the correct mounting of the components located within the filter can be controlled. Such other components are for instance the lead-through connectors shown in FIGS. 4, 4(*a*) and 4(*b*).

In FIG. 8 it is further presumed that the filters are tuned during the production in a special tuning bench. It consists of a frame, where the first (or second) part of the filter can be fastened, and means for attaching a temporary or the final second (or first) part to the part to be tested, without fixing it in its place; such a means can be for instance a model of the second (or of the first) part which is fastened in a certain clamp jaw, whereby the model is pressed over the first (or the second) part during the tuning. Then the electrical characteristics of this temporary assembled filter are measured, and if they do not fulfil the objectives, then the tested part is modified, for instance by milling a certain inner conductor or coupling element at a desired place, so that it size will decrease, or by bending a certain coupling element into a slightly different position. The temporary assembly is made again, and the electrical characteristics are tested. If the desired result is still not reached, a re-trimming can be tried, or the tested part may be rejected. In FIG. 8 the tuning phase is represented by the steps 805, 806 and 807. In step 808 the corresponding second (or first) part is fastened to the tuned first (or second) part for good, and then there is most advantageously an approval test according to the step 809, from which the product is supplied, either as an approved one to the packing 810, or as a rejected one to material re-cycling 811.

The above presented embodiments are not intended to be limiting regarding the invention. For instance, particularly extruding has been treated as the manufacturing method for the parts of the structure, but the invention also covers other such manufacturing methods, in which a certain part is made in one operation from a uniform raw-material into the final form. Similarly, even though the description above presented mainly such structures where the side walls are perpendicular to each other, the invention is suitable also for such resonators and filters where the side walls form a circle or oval, or where they are formed in some other way. Neither is it necessary that the cross-section of the inner conductor is circular, even though the description above presented mainly circular inner conductors; the cross-section of the inner conductor can be for instance an oval, a rectangle or a triangle. The invention does not in any way restrict the number of resonators belonging to the structure according to the invention, nor the number of ports, and there is no restriction on whether the filter comprises quarter-wave resonators or half-wave resonators, or both. The resonator and filter structures according to the invention are suitable for radio frequency filters, particularly in a frequency range which extends from hundreds of megahertz to several gigahertz.

What is claimed is:

1. A filter comprising a plurality of resonators, each of said resonators having an inner conductor and an outer conductor, said outer conductor being shared by said plurality of resonators, said filter including a first and second piece placed against each other, said pieces being integral and homogeneous, said first piece including each inner conductor and a part of the outer conductor, said second piece including another part of the outer conductor, which, together with the first piece, form a continuous outer conductor for each of said resonators so that the one end of each inner conductor remains open within said continuous outer conductor, said second piece further comprising coupling means arranged to remain within said continuous outer conductors and form at least one capacitance hat enclosing at least partly said open end of an inner conductor.

2. A filter according to claim 1, wherein the parts of the outer conductors contained in the first piece extend in substantially the same direction as the inner conductors at least to the level of the middle of the inner conductors.

3. A filter according to claim 1, wherein the coupling means comprise a number of coupling pins which project into the closed space defined by the outer conductor when the first piece is attached to the second piece.

4. A filter according to claim 1, further comprising coupling windows between the inner conductors of the resonators.

5. A filter according to claim 1, wherein the first piece further comprises coupling, means which are integral with and of the same material as that part of the outer conductor belonging to the first piece.

6. A filter according to claim 5, wherein said coupling means comprise coupling pins which remain within said continuous outer conductor.

* * * * *

UNITED STATES PATENT AND TRADEMARK OFFICE

CERTIFICATE OF CORRECTION

PATENT NO. : 6,320,482 B1 
DATED : November 20, 2001
INVENTOR(S) : Jouni Ala-Kojola et al.

It is certified that error appears in the above-identified patent and that said Letters Patent is hereby corrected as shown below:

Title page,
Item [73], Assignee, change, "LK Products Oy" to -- Filtronic LK Oy --.

Signed and Sealed this

Eighth Day of April, 2003

JAMES E. ROGAN
*Director of the United States Patent and Trademark Office*